US005907928A

United States Patent [19]

Charbonnel

[11] Patent Number: 5,907,928

[45] Date of Patent: Jun. 1, 1999

[54] REMOVABLE PROTECTIVE SHELTER FOR AN ACTIVITY OR LEISURE AREA

[76] Inventor: Paul Charbonnel, Maison Basile, Benesse-Maremne, France, F-40230

[21] Appl. No.: 09/029,783

[22] PCT Filed: Sep. 9, 1996

[86] PCT No.: PCT/IB96/01020

§ 371 Date: Mar. 11, 1998

§ 102(e) Date: Mar. 11, 1998

[87] PCT Pub. No.: WO97/10390

PCT Pub. Date: Mar. 20, 1997

[30] Foreign Application Priority Data

Sep. 11, 1995 [FR] France ..... 95 10784

[51] Int. Cl.[6] ..... E04H 1/12; E04H 15/36; E04H 15/46; E04B 1/346

[52] U.S. Cl. ..... 52/67; 52/86; 160/202

[58] Field of Search ..... 52/67, 86, 243.1; 160/197, 202, 211, 216

[56] References Cited

U.S. PATENT DOCUMENTS

| | | | |
|---|---|---|---|
| 1,896,433 | 2/1933 | Windeknecht | 52/67 |
| 2,833,346 | 5/1958 | Preston | 160/197 |
| 2,895,183 | 7/1959 | Dumbolton | 160/197 |
| 4,271,644 | 6/1981 | Rilliet | 52/67 |
| 4,674,241 | 6/1987 | Sarrazin | 52/67 |
| 5,661,928 | 9/1997 | Beu | 52/67 |

FOREIGN PATENT DOCUMENTS

| | | | |
|---|---|---|---|
| 1059516 | 11/1953 | France | 52/67 |
| 8800875 | 11/1989 | United Kingdom | 52/67 |

*Primary Examiner*—Carl D. Friedman
*Assistant Examiner*—Dennis L. Dorsey
*Attorney, Agent, or Firm*—Richard M. Goldberg

[57] ABSTRACT

The invention relates to a removable protective shelter. It comprises a substantially rigid frame and a substantially watertight cover. The frame and cover form a plurality of telescopic shelter elements, every shelter element being assembled on watertight slides with regard to another adjacent shelter element by means of at least another roller-guiding system allowing the overall and relative movement of all shelter elements with regard to each other in particular with no lateral play. The shelter can be used for the protection of swimming pools, terraces, and the construction of mobile verandas

15 Claims, 4 Drawing Sheets

REMOVABLE PROTECTIVE SHELTER FOR AN ACTIVITY OR LEISURE AREA

BACKGROUND OF THE INVENTION

The invention relates to a removable protective shelter for an activity or leisure area.

At present, an increasing number of installations used for different types of activities or for leisure purposes must be protected in particular from poor weather conditions, at least on a temporary basis, in order to ensure that the outdoor activity or leisure nature of these activities is maintained. This is the case for example of swimming pools, play areas, terraces, greenhouses, entrances to stadiums or other.

Since the construction of a permanent cover cannot be easily considered because of the above-mentioned reasons, removable protective structures have been proposed in which no guiding structure on the ground is used in order to simplify the implementation of such structures.

In a first known arrangement, telescopic components are erected with no rails on the ground, a guide wheel being provided on each side of every component. This arrangement does not allow for the lateral tensile stresses that are applied during use and does not permit the shelter to be suitably positioned in order to be fixed to the ground.

A second known arrangement proposed the use of rigid rails as a connection between the various components. However, this system proved to be of little practical use because of the systematic jamming of one or more components during the tensile forces and/or pressure applied to open up the shelter or during uncoordinated handling. In addition, in this second embodiment, anchoring to the ground, ensured by means of bolts, is time-consuming and tedious and the inadequate seal between components does not provide the shelter with the necessary corresponding quality.

Finally, due to the required presence of two rigid rails on the ground, the application of this type of structure to the installation of shelters of the movable veranda type cannot be easily envisaged.

There is disclosed in FR-A-2,568,288 and FR-A-2,575,955 a telescopic protective shelter of the general type already described but in which each shelter element is connected to an adjacent shelter element by a single guiding device which includes a roller.

However, in operation such an arrangement has a tendency to jam when the shelter is being extended or contracted telescopically, due to the inadequacy of the aforementioned guiding arrangement.

SUMMARY OF THE INVENTION

The object of this invention is to overcome the problems of shelter devices referred to above.

Another object of this invention is the implementation of a removable protective shelter for an activity or leisure area consisting of several telescopic shelter elements in which the overall and relative movement of all the shelter elements between them, with no lateral play, is obtained.

Another object of this invention is the implementation of a removable protective shelter for an activity or leisure area that allows rapid and effective fixing to the ground thereby ensuring great ease of implementation and use for the shelter thus obtained.

Another object of this invention is the implementation of a removable protective shelter for an activity or leisure area made up of several telescopic shelter elements in which a specific frame can be implemented, in accordance with the intended purpose of the shelter and/or its climatic environment.

Another object of this invention is the implementation of a removable protective shelter for an activity or leisure area thanks to which, with a minor adjustment to the design, in addition to a necessary adjustment to the shape, and application for the execution of movable verandas can easily be achieved.

The removable protective shelter for an activity or leisure area, which is the subject of this invention, consists of a substantially rigid frame and a substantially watertight cover over the frame.

It is significant in so far as the frame and cover form a plurality of telescopic shelter elements, that shelter element is assembled on watertight slides with regard to another adjacent shelter element by means of at least one dual roller-guiding system allowing the overall and relative movement of all shelter elements with regard to each other, with no lateral play.

It can be applied to the protection of all types of activity or leisure areas such as, in particular, swimming pools, terraces, verandas, entrances to stadiums or any building.

BRIEF DESCRIPTION OF THE DRAWINGS

It will be better understood when reading the description and examining the following drawings in which.

DETAILED DESCRIPTION

A more detailed description of the removable protective shelter for an activity or leisure area, which conforms to the object of this invention, will now be provided by referring to FIGS. 1*a*, 1*b*, 1*c*, 1*d* and subsequent ones. According to FIG. 1*a*, the removable protective shelter for an activity or leisure area, which forms the object of this invention, comprises a substantially rigid frame and a substantially watertight cover over the frame, the frame and cover forming several telescopic shelter elements. Every shelter element, such as, for example, shelter element $A_1$, is assembled with regard to another adjacent shelter element $A_2$, by means of at least one dual roller-guiding system allowing the overall and relative movement of all shelter elements with regard to each other and of protective shelter A, with no lateral play.

Figure 1A:
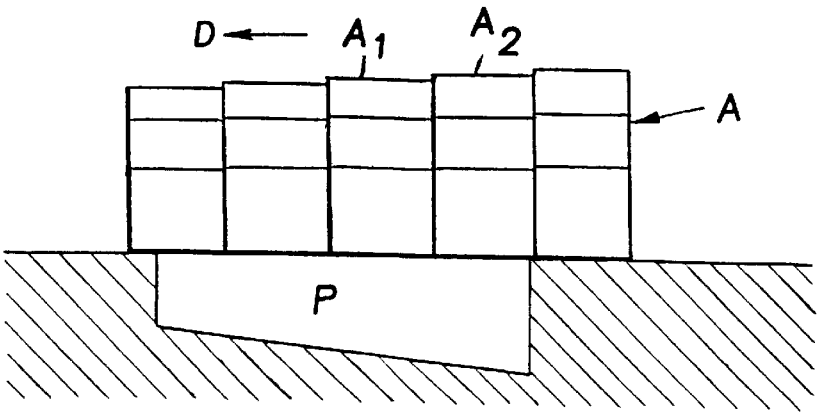
FIG. 1*a* is a sectional view of a shelter conforming to the object of this invention.

FIG. 1*a* illustrates the case of a protective shelter according to the invention, in opening direction D indicated by the arrow, for the protection of, for example, a swimming pool P.

Figure 1B:
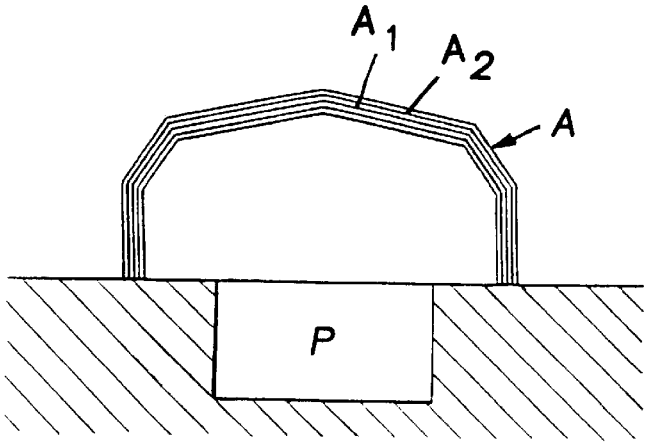
FIG. 1*b* is a front view of a shelter conforming to the object of this invention according to FIG. 1*a;*

In general, as shown in the front view in FIG. 1*b*, the frame of every shelter element $A_1$, $A_2$, or other consists of uprights of aluminium section assembled by means of connection angles.

Every shelter element is arch-shaped, as represented in FIG. 1*b* mentioned above, and every arch can be complete or partial depending on the application required.

It must generally be pointed out that the longitudinal side ends of every shelter element such as $A_1$, $A_2$ or other are fitted with multiple rolling devices in order to facilitate the movement of the whole unit over a rolling area adjacent to the activity or leisure area to be protected.

Figure 1C:
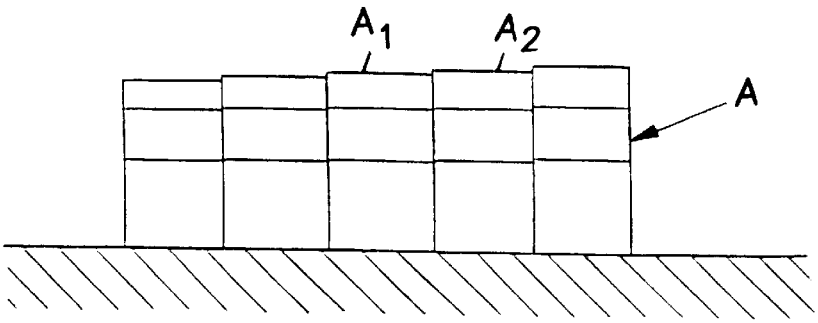
FIG. 1*c* is a sectional view of a shelter conforming to the object of this invention in a more specific application for the protection of a terrace, the shelter forming a removable veranda.
Figure 1D:
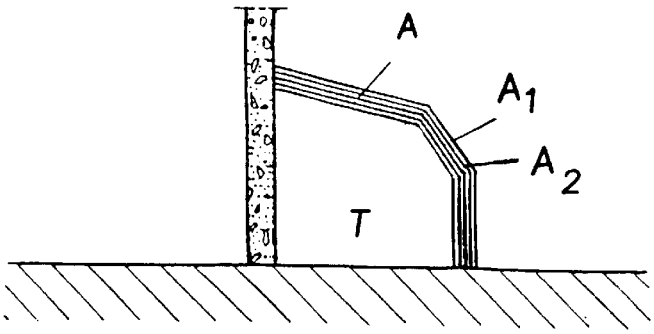
FIG. 1*d* is a front view of a shelter conforming to the object of this invention in the application of FIG. 1*c;*

FIGS. 1*c*and 1*d* represent, as a non-restrictive installation variant, a more specific case of the application of the protective shelter conforming to the object of this invention in which the shape of every shelter element is that of a partial arch, shelter A thus executed being intended for the protection of a terrace T and, if need be, to form a removable veranda.

In the specific case of the application of the protective shelter according to the invention to a terrace, as represented in FIGS. 1*c* and 1*d*, it must be pointed out that the longitudinal side end of every shelter element $A_1$, $A_2$ or other which is not situated close to the ground can be advantageously inserted in a running rail fixed to the wall carrying this longitudinal side end.

A more detailed description of the arrangement of every shelter element in the case of applications such as those represented in FIGS. 1*a*, 1*b* and 1*c*, 1*d* will now be given by referring to FIGS. 2*a*, 2*b*, 2*c*, 2*d*.

Figure 2B:
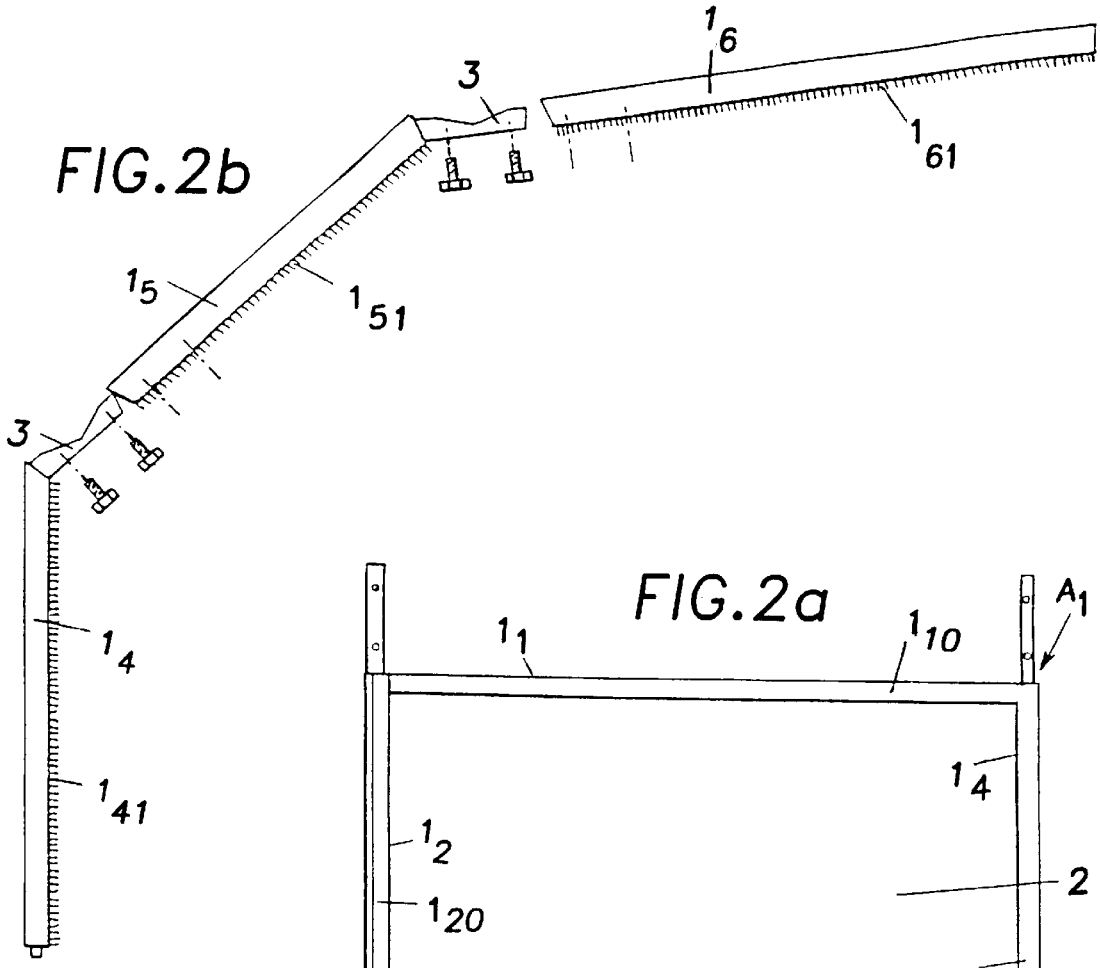
FIG. 2*b* represents a detail of the implementation of the shelter element represented in FIG. 2*a;*
Figure 2A:
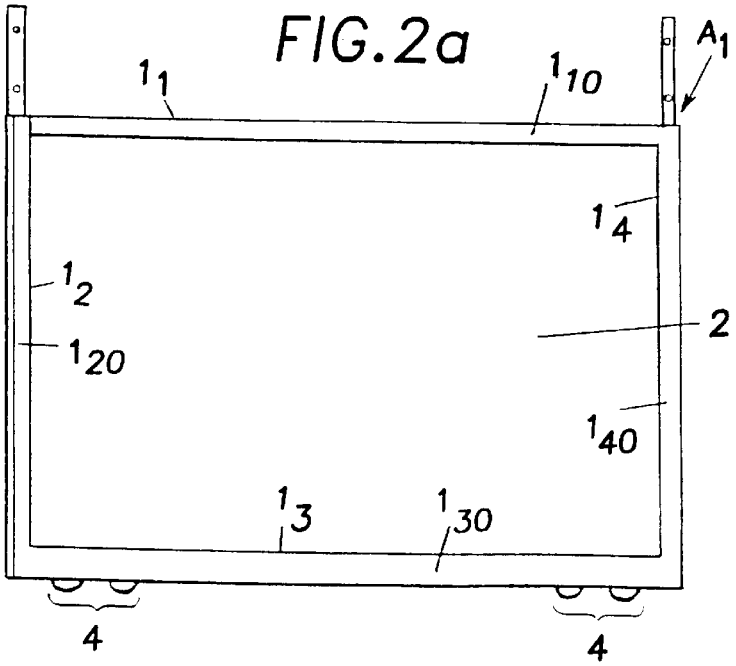
FIG. 2*a* represents an example of the implementation of a constituent shelter element of the shelter forming the object of this invention.
Figure 2C:
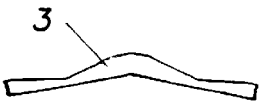
FIGS. 2*c* and 2*d* represent the assembly components of the shelter element as represented in FIGS. 2*a* and 2*b;*

In general, as represented in FIG. 2*a*, it must be pointed out that every shelter element such as shelter $A_1$ is made up a frame 1 consisting of aluminium sections which constitute the uprights of this frame and are marked with references $\mathbf{1}_1$,$\mathbf{1}_2$,$\mathbf{1}_3$.$\mathbf{1}_4$, As also shown in FIG. 2*b*, uprights consisting likewise of aluminium sections marked with reference $\mathbf{1}_5$, $\mathbf{1}_6$ are assembled together by means of connection squares marked 3, as represented for example in FIG. 2*c*.

It must generally be pointed out that connection squares 3 are moulded and that the angles have a given value and are suitable for every application.

Figure 2D:
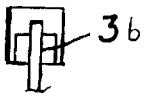

It must be pointed out that the angle of these types of squares varies thereby allowing every constituent arch of every shelter element such as $A_1$ to be executed in relation to the configuration chosen and adopted for the application considered. If shelter A and every corresponding shelter element is intended for an application as represented in FIGS. 1*c* and 1*d*, it must be pointed out that the extreme end of upright $\mathbf{1}_4$ can be fitted with an insertion clip in the running rail fixed to the wall, running clip bearing reference 3*b*, as shown in FIG. 2*d*.

It must generally be pointed out that every upright $\mathbf{1}_1$,$\mathbf{1}_2$, $\mathbf{1}_3$.$\mathbf{1}_4$ is advantageously fitted with rubber joints mounted on the outside surface of every upright, these rubber joints being marked with reference $\mathbf{1}_{10}$,$\mathbf{1}_{20}$,$\mathbf{1}_{30}$,$\mathbf{1}_{40}$.

The frame thus executed with the implementation of uprights $\mathbf{1}_1$,$\mathbf{1}_2$,$\mathbf{1}_3$.$\mathbf{1}_4$, allows the formation of panels on which the cover can be installed and this cover, which is marked with reference 2, can consist of polymer or Plexiglas or polycarbonate panels.

Sealing joints $\mathbf{1}_{10}$, $\mathbf{1}_{20}$, $\mathbf{1}_{30}$, $\mathbf{1}_{40}$ can then be mounted at right angles to uprights $\mathbf{1}_1$,$\mathbf{1}_2$,$\mathbf{1}_3$.$\mathbf{1}_4$, over the previously installed cover.

In addition every internal part of uprights $\mathbf{1}_1$ to $\mathbf{1}_6$ can be fitted with covering brushes marked with reference $\mathbf{1}_{41}$ $\mathbf{1}_{51}$ and $\mathbf{1}_{61}$ as shown in FIG. 2*b*. A suitable seal between adjacent shelter elements is thus obtained thanks to the implementation of sealing joints 110 to 140 referred to above as well as the covering brushes $\mathbf{1}_{41}$, $\mathbf{1}_{51}$ and $\mathbf{1}_{61}$ previously described.

Figure 3A:
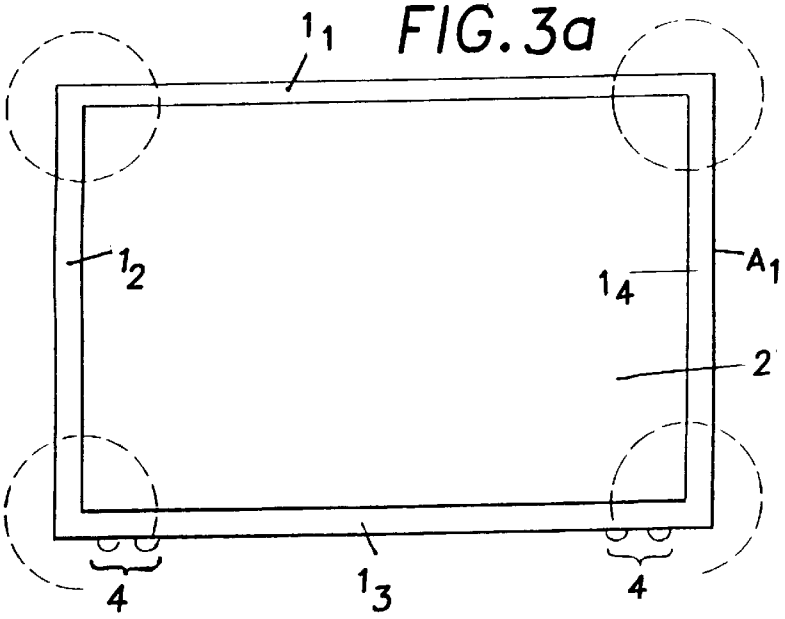
FIGS. 3*a* and 3*b* represent a detail of the implementation of the frame of the shelter element represented in FIGS. 2*a* and 2*b;*
Figure 3B:
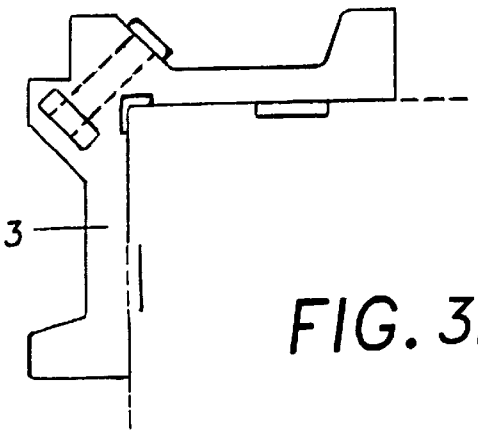

As regards the execution of every panel to which cover 2 must be applied, it must be pointed out that every substantially rectangular panel as represented in FIG. 3*a* can be executed by assembling the uprights of aluminium section $\mathbf{1}_1$,$\mathbf{1}_2$,$\mathbf{1}_3$.$\mathbf{1}_4$, by means of connection squares 3 as represented in FIG. 3*b*. The implementation of these connection squares will not be described in detail since it corresponds to a standard operation of the assembly of aluminium sections. These connection squares can advantageously consist of squares marketed under the trade mark of EVEREST for example.

Finally, it must be pointed out that the longitudinal side ends of every shelter element such as $A_1$, as represented in FIGS. 2*a* and 3*a* are fitted with multiple roller devices 4, these roller devices consisting of multiple wheels. From the practical point of view, it must be pointed out that every shelter element comprises for example at least eight wheels thus making it possible to consider a possible adjustment for ground whose surface eveness is not specifically adapted to the use of a removable protective shelter for an activity or leisure area conforming to the object of this invention. Multiple wheels 4 can be of any type and, in particular, solid rubber wheels, cellular rubber wheels or low pressure pneumatic wheels for example.

A more detailed description of an advantageous method of executing the dual roller-guiding system between adjacent shelter elements will now be given by referring to FIGS. 4*a* and 4*b*.

Figure 4A:
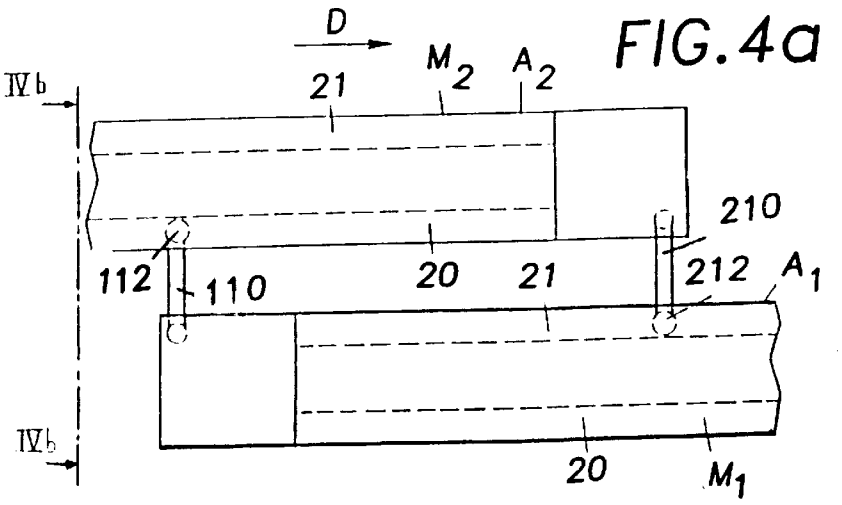
FIG. 4*a* represents a top view, along the longitudinal cross-section of the dual roller-guiding system fitted to all shelter elements and all adjacent shelter elements constituting the shelter which forms the object of this invention.
Figure 4B:
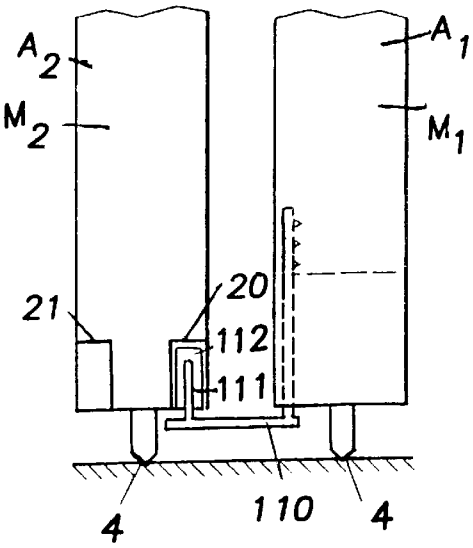
FIG. 4*b* represents a sectional view according to section A—A of FIG. 4*a*.

According to FIG. 4*a*, it must be pointed out that, in the opening direction of the shelter, arrow D in FIG. 4*a*, shelter A finally consists of at least one shelter element at the front, for example shelter element $A_1$, and of at least one shelter element at the back adjacent shelter element $A_2$. In fact a shelter element which is not situated at the end of shelter A constitutes a front shelter element and a rear shelter element according to the definition given above. Every shelter element situated at the end of the shelter, which is the object of this invention, in fact constitutes either a front shelter element or a rear shelter element of vice-versa.

As represented in FIG. 4*a*, it must be pointed out that every front shelter element such as shelter element $A_1$ comprises, at the level of every longitudinal side end, that is to say upright $M_1$ in FIG. 4*a*, which is nothing else but upright $\mathbf{1}_3$ in FIG. 3*a* fitted for example with all its accessories, cover 2, sealing joint and multiple wheel 4, at least one guiding groove marked with reference 21, which is situated on the longitudinal side end mentioned above, on the outside surface of front shelter element A.

In addition as shown in FIG. 4*a*, every rear shelter element such as for example $A_2$ comprises, in the same opening direction of the shelter, at the level of every longitudinal side end, at least one guiding device positioned near the inside surface of this rear shelter element $A_2$. This guiding device comprises at least one guiding roller marked with reference 212 which is inserted in guiding groove 21 of front shelter element $A_1$.

Where possible, guiding roller 212 is assembled on a transverse arm 210 fixed directly at the end of the side upright $M_2$ or rear shelter element $A_2$.

According to a particularly advantageous feature of the dual guiding device between the front and rear shelter elements mentioned above, it must also be pointed out that, vice-versa, every rear shelter element such as for example shelter element $A_2$, includes a guiding groove 20 provided on the longitudinal side end, on the inside surface of this rear shelter element and that every front shelter element such as shelter $A_1$, in the same opening direction of the shelter. includes at the level of every longitudinal side end, a corresponding guiding element positioned close to the outside surface of this front shelter element $A_1$, and includes at least one guiding roller 112, which is inserted in guiding groove 20 of the rear shelter element $A_2$.

It can thus be understood that any front and rear shelter element, that is to say any shelter element other than an end shelter element is advantageously provided, at the level of every longitudinal side end, that is to say on uprights $M_1$, $M_2$ as represented for shelter elements $A_1$ and $A_2$ respectively in FIG. 4*a*, with two grooves 20 and 21 in which a guiding roller 112, or 212 respectively, integral to upright $M_1$ of front shelter element $A_1$, or to upright $M_2$ of rear shelter element $A_2$ respectively, is inserted.

It must generally be pointed out that the guiding roller 112, 212 can consist of a polytetrafluoroethylene roller, which then allows guiding with minimum friction when placed in groove 20, or corresponding groove 21 respectively. Roller 112 can then be assembled in a conventional way along guiding axis 111 and rotated into position on the latter in such a way as to guarantee the guiding function mentioned above. The same applies to roller 212.

Thus, it is clear that every shelter element comprises at least one guiding component positioned at its fore and/or rear front end.

In order to ensure that the removable protective shelter for an activity or leisure area conforming to the object of this invention is anchored into position once suitably opened, it must be pointed out that at least one of the shelter elements can include an anchoring system to the ground to allow the shelter element to be fixed in a given position.

In this case, it is obvious that the anchoring devices can be positioned on the ground at predefined places and that one or more of these anchoring devices can be positioned on the shelter element running path according to a given pitch. A more detailed description of this anchoring system will be given by referring to FIG. 5.

The above mentioned figure is a front view of a shelter element such as shelter element $A_2$ shown in FIG. 3*a*.

Figure 5:
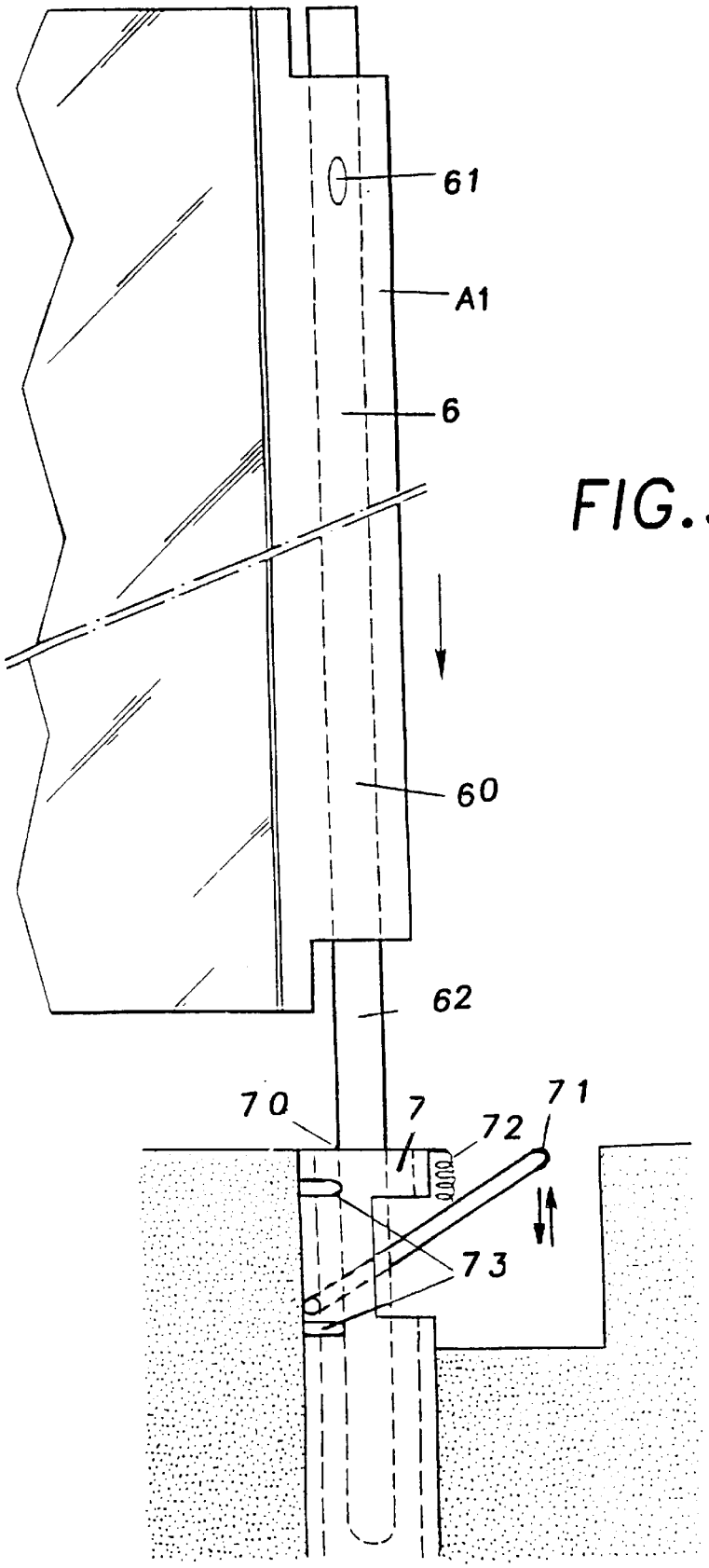
FIG. 5 represents, by way of a non-restrictive example, a detail of the execution of the anchoring to the ground of one or several constituent shelter elements of a shelter according to the invention.

As shown in FIG. 5 mentioned above, at least one of the uprights such as upright $\mathbf{1}_4$, for example vertical, can be fitted with an anchoring device 6 consisting of a rod 60 fitted at its end 62 with several locking devices. Rod 60 is also fitted with an operating latch 61 which allows rod 60 to be released and to move in a vertical translation direction from bottom to top and top to bottom so as to allow end 62 to be inserted in anchor 7 laid in the ground.

As shown in FIG. 5, anchor 7 can incorporate a housing 70 into which end 62 of rod 60 is inserted when the latter is brought, by translation, into the above mentioned housing 70. Anchor 7 is also fitted with a lever 71 and catches 73, level 71 being fitted with a return spring 72 which operates lever 71 mentioned above. It is thus clear that when shelter element $A_2$ is in a suitable position the operation of rod 60 by means of the handle 61 allows end 62 to be inserted into housing 70, lever 71 having been put in a substantially horizontal tilting position to allow the whole end 62 of rod 60 to be inserted into housing 70 of anchor 7. The release of level 71, when end 62 has been suitably inserted, then allows rod 60 to be locked in by means of catches 73 and lever 71 and finally the corresponding shelter element $A_1$. If lever 71 is tilted, catches 73 can be released from the locking devices and the upright can be unlocked.

A description has thus been given of a removable protective shelter for an activity or leisure area of particularly high-performance in so far at the dual guiding system between a front shelter element and a rear shelter element provides a satisfactory connection between these shelter elements and thus ensures that the shelter elements run straight so that the shelter as a whole operates satisfactorily.

In addition it must be pointed out that the use of aluminium sections and connection squares to maintain the parts connected at the correct angle allows every shelter element and finally the shelter thus constituted to maintain its initial shape with no deformation due to the tensile stresses or pressure to which they are subject. Considering the excellent water tightness obtained from the use of joints and covering brushes, it can be envisaged, on the basis of this characteristic, that the shelter will be used far more frequently and thus that its use will prove extremely flexible.

Considering this aspect, it must be pointed out that the installation of verandas is thus facilitated and that the daily use and operating of this type of veranda will prove particularly attractive to users.

In addition it must be pointed out that in view of the good linearity and rigidity of the unit thus obtained, such rigidity in no way affecting the ease with which the shelter thus constituted can be opened up, it is quite feasible to envisage the implementation of motor-operated multiple wheels and a suitable control for the motor operation in order to allow accurate positioning, in particular at the anchoring points as previously indicated in the description.

What is claimed is:

1. A telescopic shelter comprising a plurality of shelter elements having ground engaging elements by which the shelter elements can be moved with respect to a supporting surface and having guides interconnecting adjacent shelter elements, wherein the guides comprise dual guiding grooves on each shelter element and forward and rear guiding elements engageable with respective grooves.

2. A telescopic shelter as claimed in claim 1, wherein the forward and rear guiding elements include roller devices, each of which is rotatable about a substantially vertical axis.

3. A telescopic shelter according to claim 2, wherein each shelter element includes a frame made up of uprights of aluminium section assembled by means of connection squares, the shape of each shelter element being at least partially an arch, and longitudinal side ends of each shelter element being fitted with multiple said roller devices.

4. A telescopic shelter according to claim 2, wherein at least one of the shelter elements comprises an anchoring system to anchor the respective shelter element to ground, allowing said shelter element to be fixed in a given position.

5. A telescopic shelter according to claim 2, wherein the roller devices include multiple wheels positioned at a front end of every shelter element.

6. A telescopic shelter according to claim 5, wherein at least one of the shelter elements comprises an anchoring system to anchor the respective shelter element to ground, allowing said shelter element to be fixed in a given position.

7. A telescopic shelter according to claim 2, wherein each shelter element is fitted, on at least one transverse side end thereof, with rubber joints and covering brushes between the movable shelter elements, thereby allowing waterproof sliding of said shelter elements.

8. A telescopic shelter according to claim 7, wherein the roller devices include multiple wheels positioned at a front end of every shelter element.

9. A telescopic shelter according to claim 1, wherein at least one of the shelter elements comprises an anchoring system to anchor the respective shelter element to ground, allowing said shelter element to be fixed in a given position.

10. A telescopic shelter according to claim 1, wherein each shelter element is fitted, on at least one transverse side end thereof, with rubber joints and covering brushes between the movable shelter elements, thereby allowing waterproof sliding of said shelter elements.

11. A telescopic shelter according to claim 10, wherein at least one of the shelter elements comprises an anchoring system to anchor the respective shelter element to ground, allowing said shelter element to be fixed in a given position.

12. A telescopic shelter according to claim 1, wherein each shelter element includes a frame made up of uprights of aluminium section assembled by means of connection squares, the shape of each shelter element being at least partially an arch, and longitudinal side ends of each shelter element being fitted with multiple roller devices.

13. A telescopic shelter according to claim 12, wherein each shelter element is fitted, on at least one transverse side end thereof, with rubber joints and covering brushes between the movable shelter elements, thereby allowing waterproof sliding of said shelter elements.

14. A telescopic shelter according to claim 12, wherein at least one of the shelter elements comprises an anchoring system to anchor the respective shelter element to ground, allowing said shelter element to be fixed in a given position.

15. A telescopic shelter according to claim 12, wherein the roller devices include multiple wheels positioned at a front end of every shelter element.

* * * * *